US007775421B2

(12) United States Patent
Clary

(10) Patent No.: US 7,775,421 B2
(45) Date of Patent: Aug. 17, 2010

(54) DEVICE FOR DETERMINING THE SEX (GENDER) OF FISH BY MEASUREMENT OF MORPHOLOGICAL CHARACTERISTICS

(76) Inventor: Susannah Lee Clary, 821 Miller Rd., Los Lunas, NM (US) 87031

( * ) Notice: Subject to any disclaimer, the term of this patent is extended or adjusted under 35 U.S.C. 154(b) by 759 days.

(21) Appl. No.: 11/580,254

(22) Filed: Oct. 12, 2006

(65) Prior Publication Data

US 2008/0210766 A1 Sep. 4, 2008

Related U.S. Application Data

(60) Provisional application No. 60/726,998, filed on Oct. 17, 2005.

(51) Int. Cl.
*G06G 1/00* (2006.01)

(52) U.S. Cl. ..... 235/70 A; 235/71 A

(58) Field of Classification Search ..... 235/70 R, 235/70 A, 70 C, 71 A
See application file for complete search history.

*Primary Examiner*—Karl D. Frech

(57) ABSTRACT

This measuring tool permits the measurement of all critical morphological characteristics of fish, including the new ones identified by the author in May 2005*, thereby allowing for the determination of gender (sex). The device incorporates three measurement scales in metric and standard units and a calibrated gender bar. In combination, these permit the determination of sex of a fish at any size, any age and at any time of the year. There are several variations of the device, which include: 1. Placement of the measuring arm in relation to the measurement scales and its size (to accommodate larger or smaller fish). 2. Variations of the range for male and female fish on the gender bar. 3. Inclusion of log-log scales for statistical applications.

Clary, S.L., 2005. Age and Morphological Differences between Male and Female Kokanee Salmon, Fish and Wildlife Service Conservation Library, US Dept. of the Interior, Washington, D.C.

4 Claims, 9 Drawing Sheets

DEVICE FOR DETERMINING THE SEX (GENDER) OF FISH BY MEASUREMENT OF MORPHOLOGICAL CHARACTERISTICS

A device for determining the sex (gender) of fish by measurement of morphological characteristics comprising: a plurality of ruler assemblies to measure total length, fork length, body length and head length; a gender bar calibrated for the range of head length to body length ratios; a sliding rule to measure the body length from a reference point; and a sliding arm assembly capable of simultaneously measuring head length, body length. There are no similar devices, which can accomplish either task separately or in combination.

FIELD OF INVENTION

The device relates to fisheries management of wild and domestic stocks of fish to provide for a means of ascertaining sex. (Class 119)

OPERATIONAL DESCRIPTION OF THE DEVICE

Figure 1:
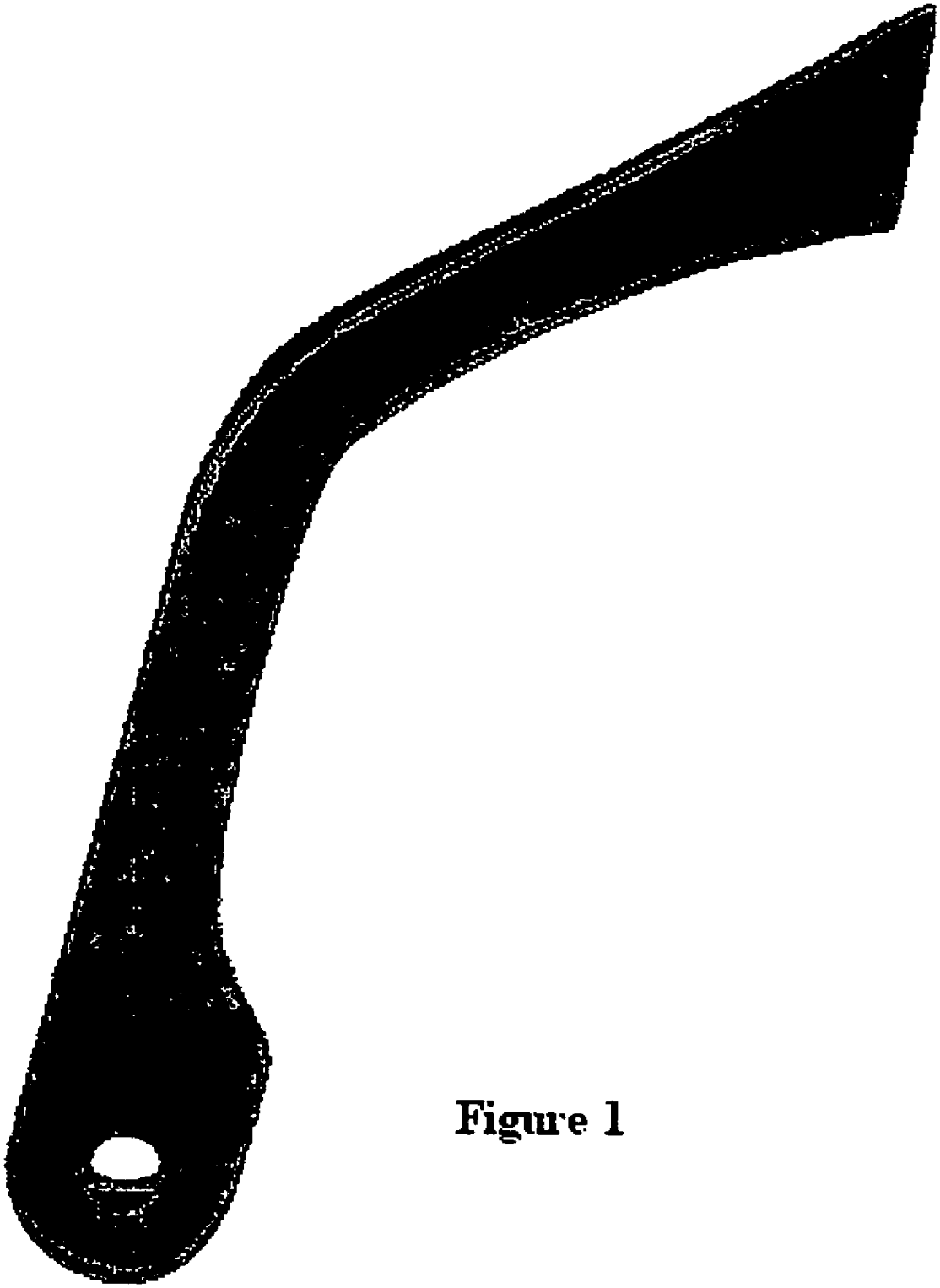
FIG. 1 is a side view of the pivoting sliding arm for determining head length
Figure 2:
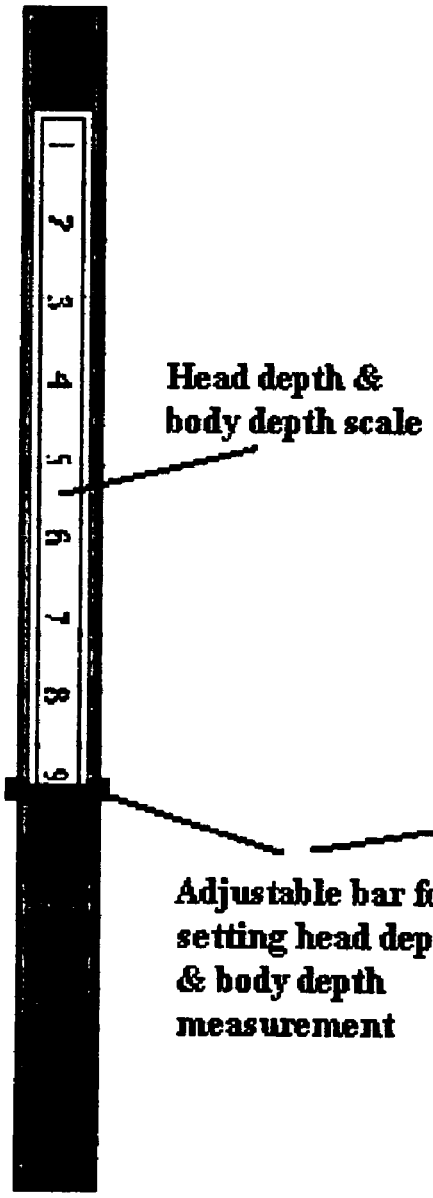
FIG. 2 is top view of the alternate pivoting sliding arm with calibrations for determining head depth as well as head length.
Figure 3:
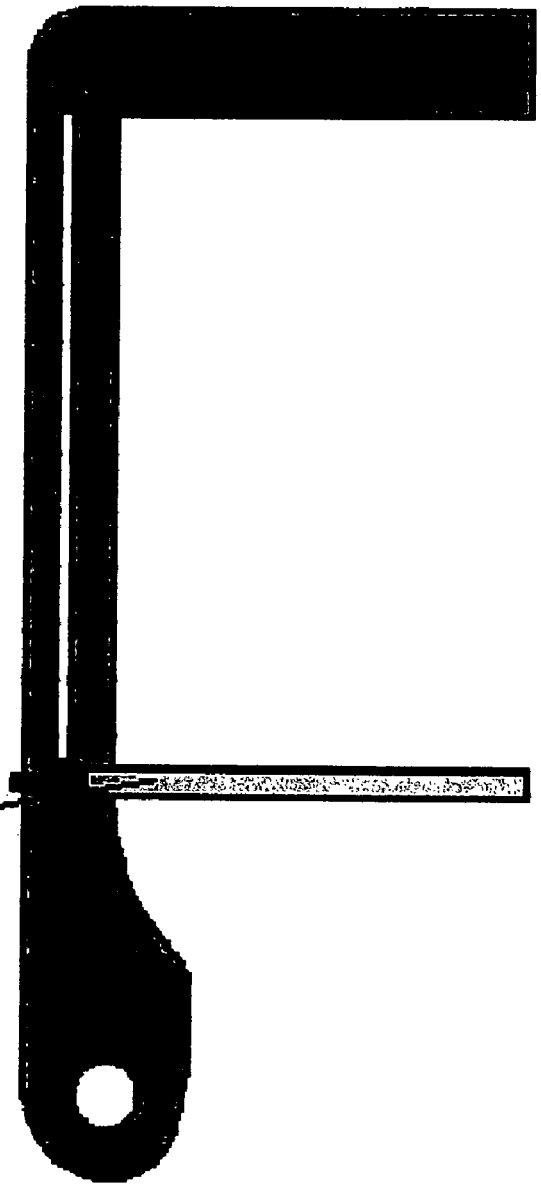
FIG. 3 is the side view of the alternate pivoting sliding arm for determining head depth and head length with an adjustable bar to "set" the measurement.
Figure 4:
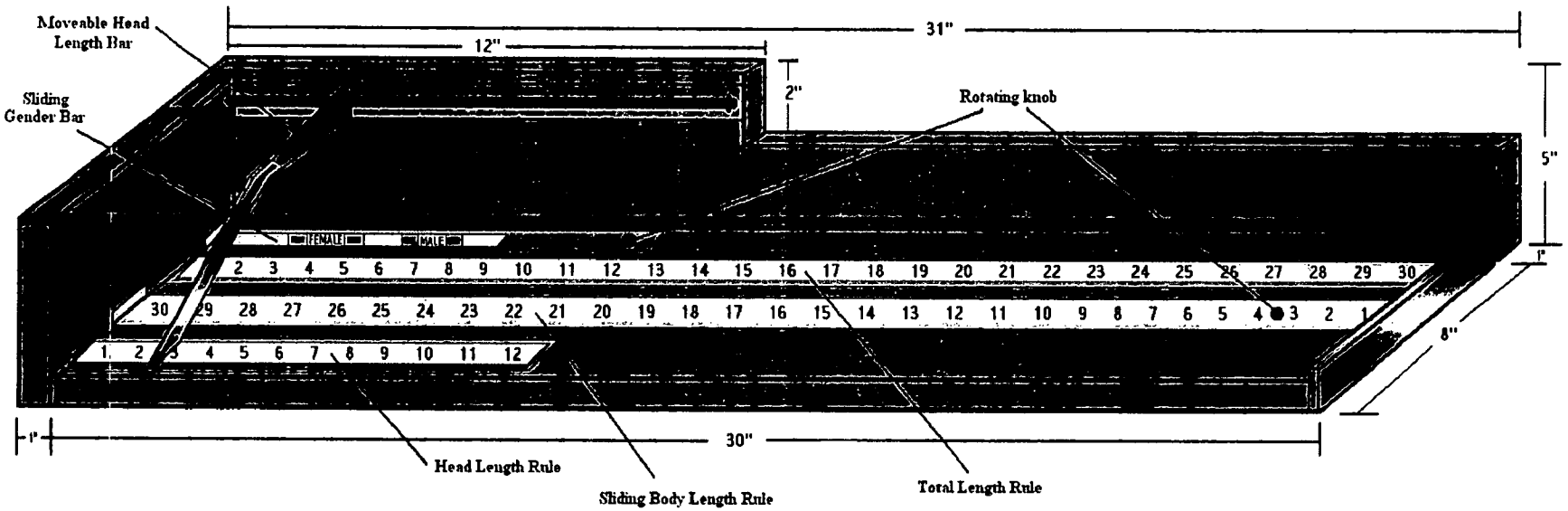
FIG. 4 is a frontal perspective view of the field prototype device that was actually constructed and tested. The individual components and dimensions are labeled for clarity. All rulers possess both metric and standard measurements, although only standard are shown in this drawing.
Figure 5:
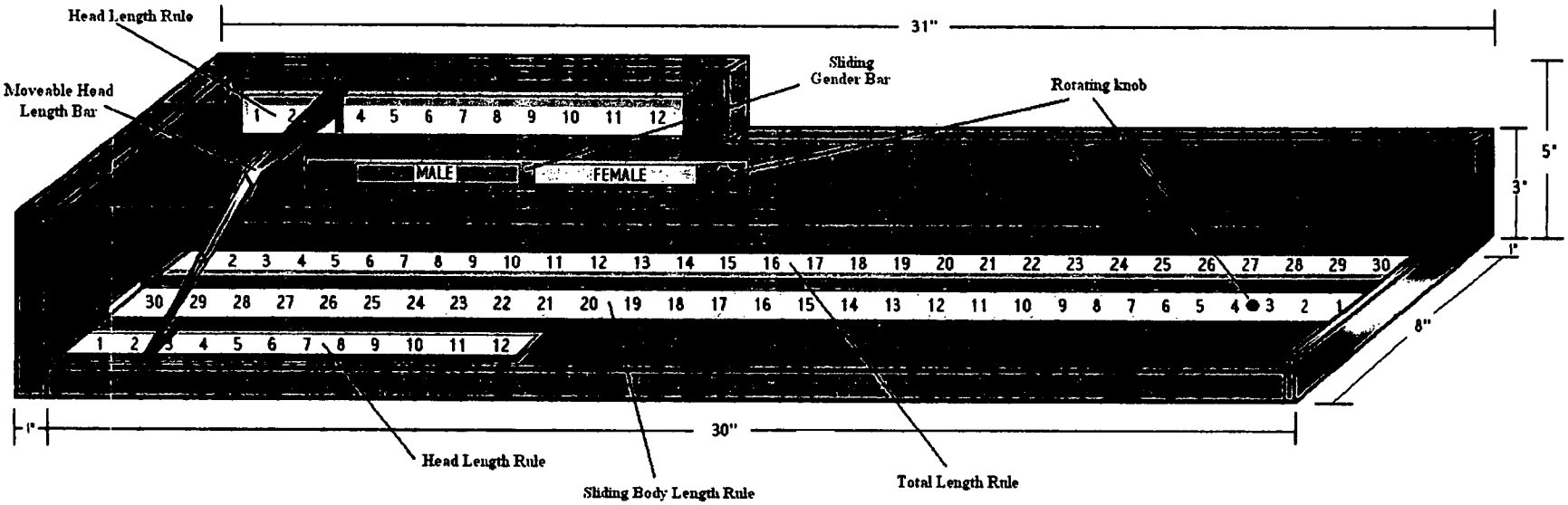
FIG. 5 is a frontal perspective view of an alternate field prototype device which has two rules for head length measurement with the sliding gender bar located on the back wall. All rulers possess both metric and standard measurements, although only standard are shown in this drawing.
Figure 6:
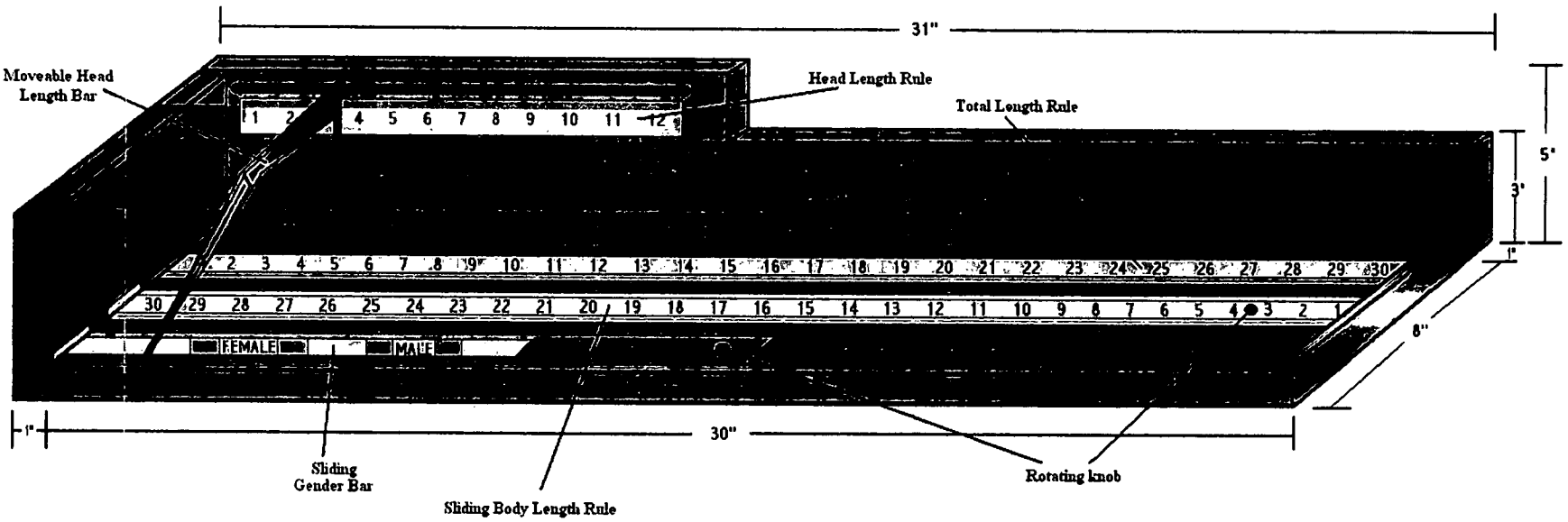
FIG. 6 is a frontal perspective view of the final field prototype which moved the location of the sliding gender bar to the front of the device for easier reading. All rulers possess both metric and standard measurements, although only standard are shown in this drawing.
Figure 7:
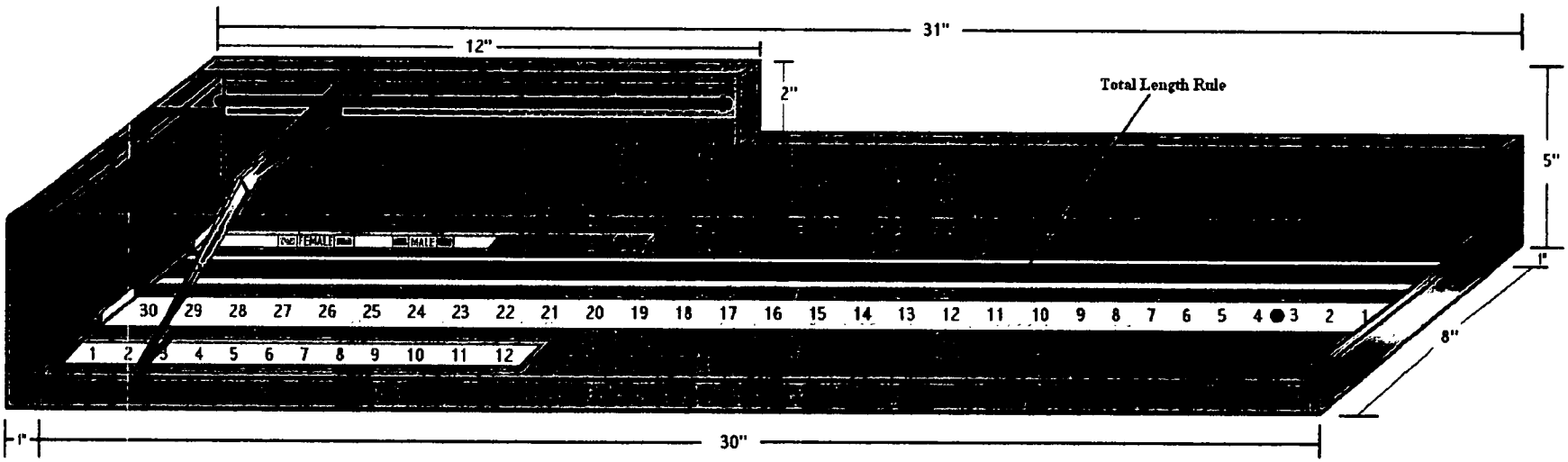
FIG. 7-8 are frontal perspective views to accompany the operational description of the field tested prototype device with the relevant components highlighted in red.

The following steps illustrate the use of the prototype device in the field:

FIG. 7. Place the fish is placed on the device and measured for total length on the fixed "total length ruler" (highlighted in red in the figure).

Figure 8:
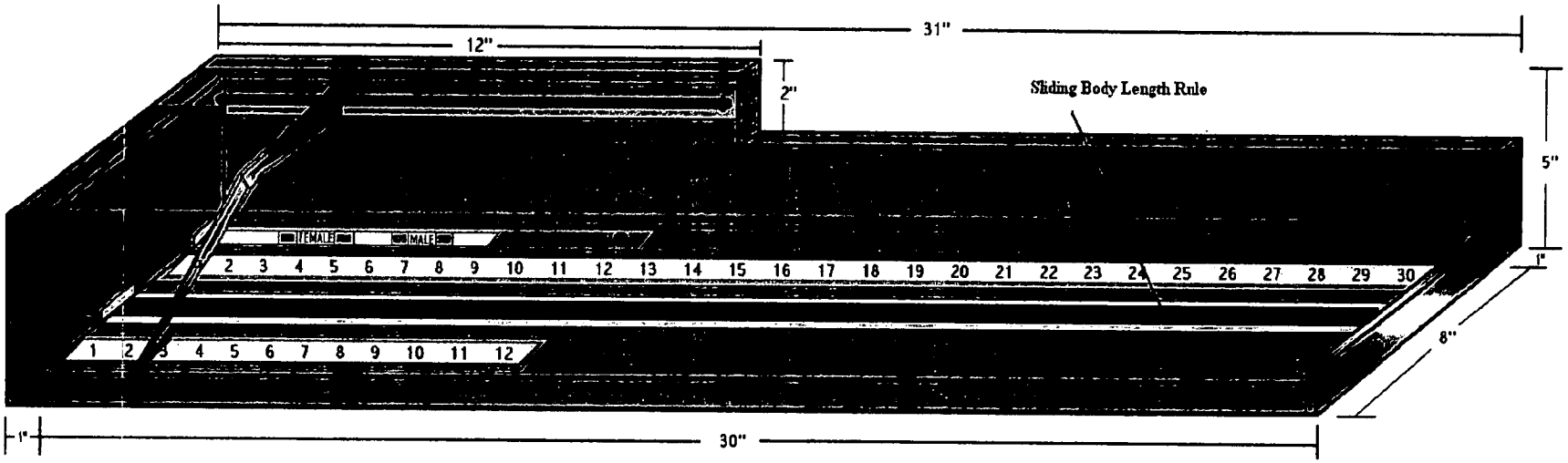

FIG. 8. Move the "body length ruler" (highlighted in red on this figure) so that the right edge coincides with the total length measurement on the total length rule. This may be cross-checked by making sure that the correct total length is indicated on this rule on the vertical board on the left side of the prototype.

Figure 9:
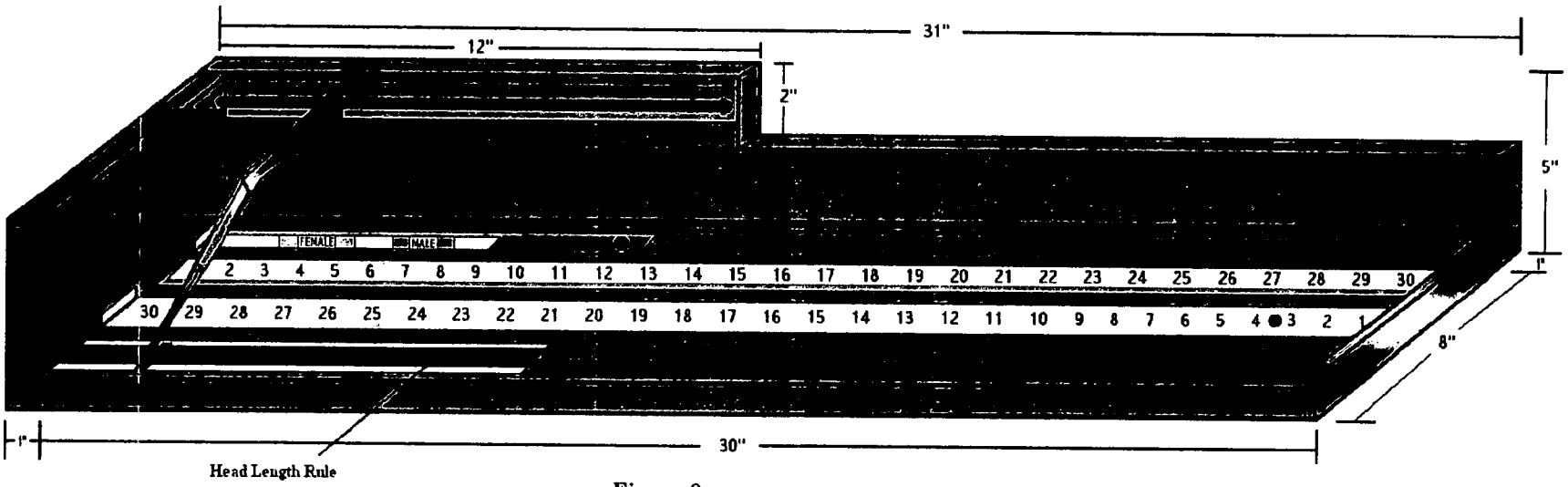
FIG. 9 and 10 show an alternate view of current invention.

FIG. 9. Move the adjustable measuring arm to the posterior edge of the operculum of the fish, and read the head length on the "head length ruler" (highlighted in red on the figure). Body length on the "body length ruler" will then be able to be read. Both measurements are taken from the left side of the measuring arm. Return the fish to the water. Average time required for measurements is 15 seconds.

Figure 10:
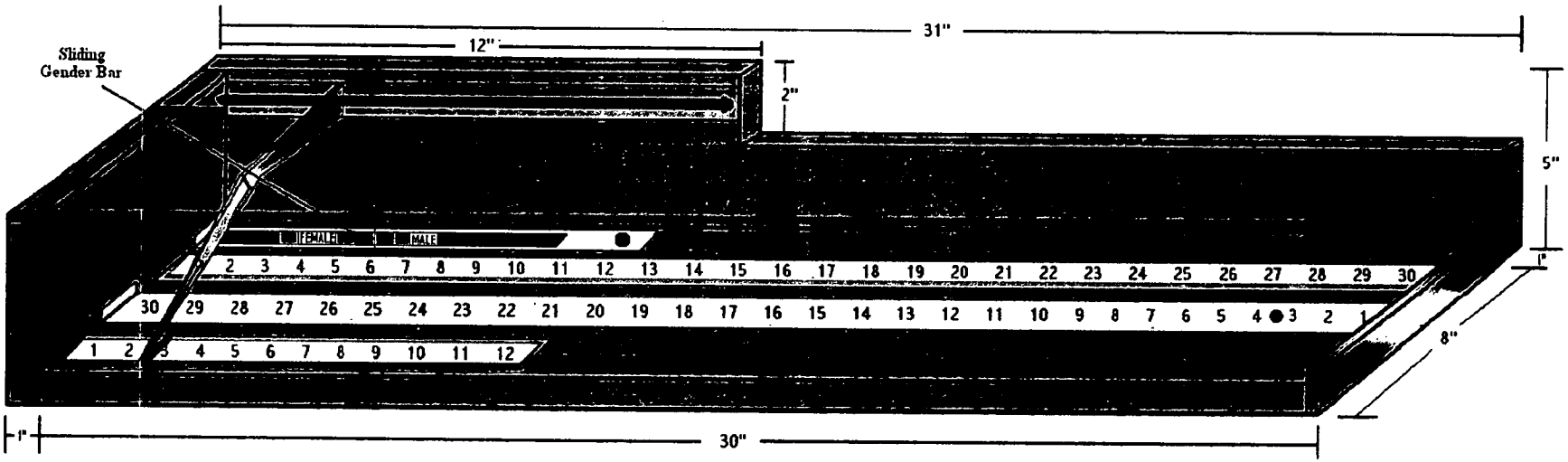

FIG. 10. After safely returning the fish to the water, move the Gender Bar (highlighted in red on the figure) so that the right edge is even with the measurement of body length on the total length ruler, which is adjacent to the gender bar. You can now "read" the sex of the fish directly beneath the moveable arm on the left side. On most fish, the measurement for head length is to the most posterior edge of the operculum. However, because of the rapid growth in developing male salmon, prior to spawning, the operculum tends to "pull away" from the cleithrum bone. Therefore, if the cleithrum is visible in any fish, an accurate measurement is obtained by using the posterior edge or ridge of the cleithrum as a reference point.

What is claimed is:

1. A device for determining the sex (gender) of fish by measurement of morphological characteristics comprising: a plurality of ruler assemblies to measure total length, fork length, body length and head length; a gender bar calibrated for the range of head length to body length ratios; a sliding rule to measure the body length from a reference point; and a sliding arm assembly capable of simultaneously measuring head length, body length comprising:

a. one sliding rule of at least 30 inches, with rotating knob, calibrated with reverse numerics in standard and metric units for marking body length measurement on the total length rule.

b. a fixed rule of twelve inches in length, calibrated in metric and standard units for measuring head length.

c. a fixed rule of at least 30 inches in length, calibrated in metric and standard units for measuring total length.

2. A device for determining the sex (gender) of fish by measurement of morphological characteristics of claim 1 comprising:

a. one pivotal sliding arm assembly with vertical scales across the top for measuring head depth and body depth.

b. a sliding arm assembly with vertical scales across the top with a moveable perpendicular bar to "lock in" head length and body length measurements.

c. a sliding arm assembly calibrated for digital readout.

3. A device for determining the sex (gender) of fish by measurement of morphological characteristics of claim 1 comprising:

a. a gender bar, with rotating knob, calibrated for head length to body length ratios in decimal logarithmic scale.

b. a gender bar calibrated for head depth and body depth ranges to determine sex.

c. a gender bar utilizing a digital readout for head depth, body depth ranges.

4. A device for determining the sex (gender) of fish by measurement of morphological characteristics of claim 1 comprising:

a. capable of being modified by increasing the width or length modification to accommodate smaller or larger fish, deeper depth and allow for body condition.

b. fabricated from any of several substances including plastic, aluminum, wood or composite graphite.

* * * * *